US007553221B2

(12) United States Patent
Hope et al.

(10) Patent No.: US 7,553,221 B2
(45) **Date of Patent: *Jun. 30, 2009**

(54) ABRASIVE HOLDER

(76) Inventors: Stephen Ross Hope, 20 Seaspray Drive, Bucklands Beach, Auckland (NZ) 1704; Robert John Welcome, 69 O'Halloran Road, Howick, Auckland (NZ) 1705; Jason Robert Jones, 62H Wellington Street, Howick, Auckland (NZ) 1705

( * ) Notice: Subject to any disclaimer, the term of this patent is extended or adjusted under 35 U.S.C. 154(b) by 124 days.

This patent is subject to a terminal disclaimer.

(21) Appl. No.: 11/538,178

(22) Filed: Oct. 3, 2006

(65) Prior Publication Data

US 2007/0082591 A1 Apr. 12, 2007

Related U.S. Application Data

(63) Continuation-in-part of application No. 10/523,183, filed on Jan. 28, 2005, now Pat. No. 7,131,902.

(30) Foreign Application Priority Data

Aug. 27, 2002 (NZ) ..... 519162
Aug. 27, 2003 (WO) ..... PCT/NZ03/00190

(51) Int. Cl.
*B24D 17/00* (2006.01)
*B24D 15/00* (2006.01)
*B24D 11/00* (2006.01)

(52) U.S. Cl. ..... 451/495; 451/523; 451/524; 451/525; 451/533; 451/539

(58) Field of Classification Search ..... 451/523–525, 451/533, 538, 539, 344, 490, 495, 359, 499, 451/501

See application file for complete search history.

(56) References Cited

U.S. PATENT DOCUMENTS

| | | | | | |
|---|---|---|---|---|---|
| 1,956,882 | A | * | 5/1934 | Stowell | 407/29.11 |
| 3,092,937 | A | * | 6/1963 | Tocci-Guilbert | 451/509 |
| 3,123,947 | A | * | 3/1964 | Rawley | 451/495 |
| 3,307,300 | A | * | 3/1967 | Field | 451/521 |
| 3,710,467 | A | * | 1/1973 | Coon et al. | 407/29.11 |
| 3,875,703 | A | * | 4/1975 | Clemente | 451/359 |
| 4,202,139 | A | * | 5/1980 | Hong et al. | 451/524 |
| 4,558,542 | A | * | 12/1985 | Marton | 451/490 |
| 5,054,248 | A | | 10/1991 | Thayer | |
| 5,479,675 | A | * | 1/1996 | Pytlewski | 15/235.4 |
| 5,700,187 | A | * | 12/1997 | Balbi | 451/495 |
| 6,007,591 | A | | 12/1999 | Watanabe | |

(Continued)

FOREIGN PATENT DOCUMENTS

GB 2114028 8/1983

*Primary Examiner*—Bryan R Muller
(74) *Attorney, Agent, or Firm*—David A. Guerra

(57) ABSTRACT

An abrasive tool comprising of a base portion (2), having a foam layer (3) affixed to the abrasive tool base portion, and a plastic film layer (4) affixed, bonded or glued to the foam layer. This tool is adapted to receive an abrasive material layer (5) or sand paper or other abrasive material having a pressure sensitive adhesive applied to one side of the abrasive material, to allow said abrasive material to be stuck and affixed to the abrasive tool. The abrasive tool may be hand operated, or operated by electric power, air power, or other motive power.

20 Claims, 8 Drawing Sheets

U.S. PATENT DOCUMENTS 6,419,573 B1 7/2002 Lise et al.
6,494,771 B2 * 12/2002 Carlson ..... 451/344
6,746,311 B1 * 6/2004 Kessel ..... 451/41
7,048,618 B1 * 5/2006 Cramer ..... 451/59
7,131,902 B2 * 11/2006 Hope ..... 451/533
2002/0025770 A1 2/2002 Carlson
2002/0081946 A1 * 6/2002 Scott et al. ..... 451/36
2003/0194963 A1 * 10/2003 Xu et al. ..... 451/533

* cited by examiner

FIG. 1a
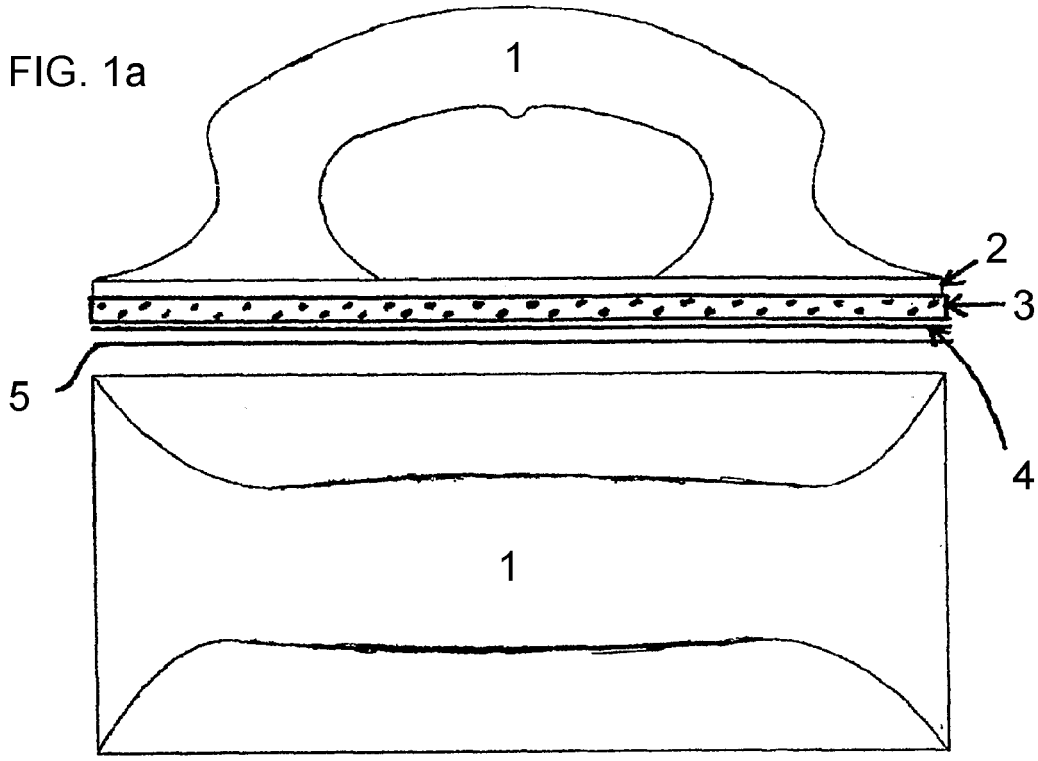
FIG. 1b
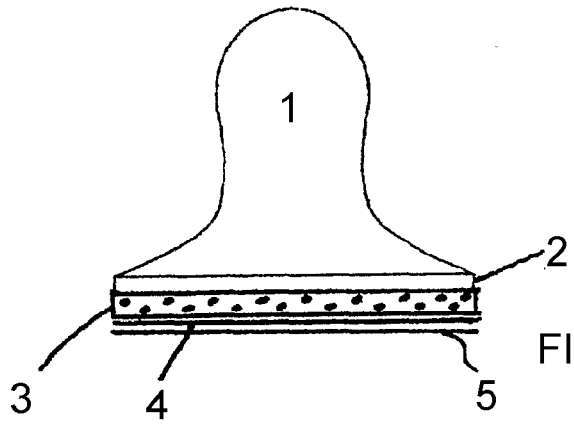
FIG. 1c

FIG. 2a
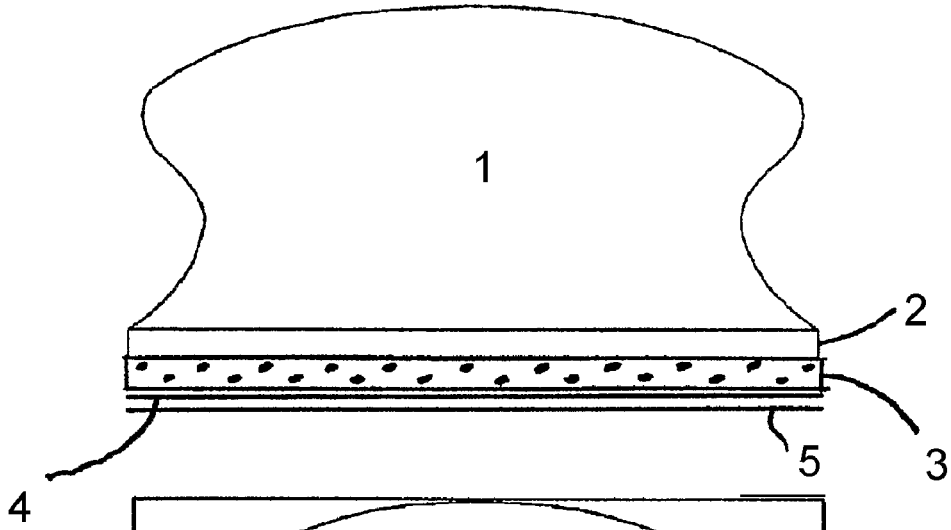
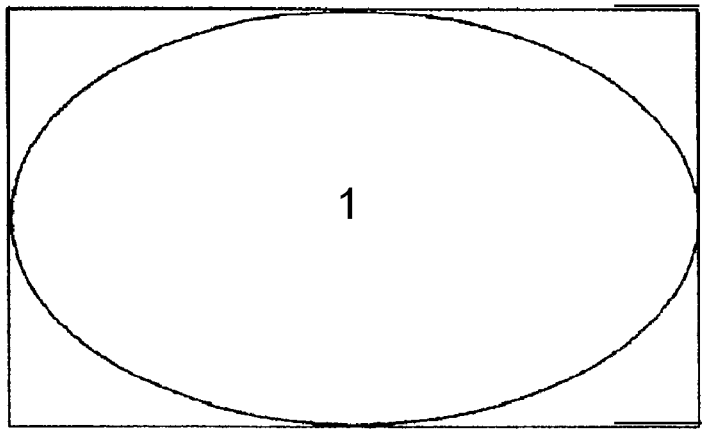
FIG. 2b
FIG. 2c
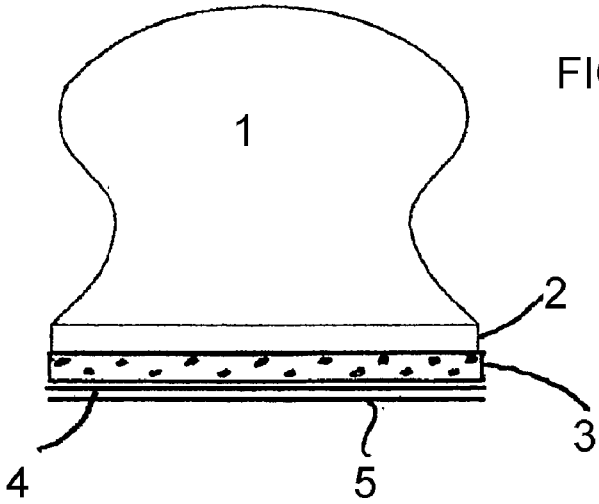

FIG. 3a
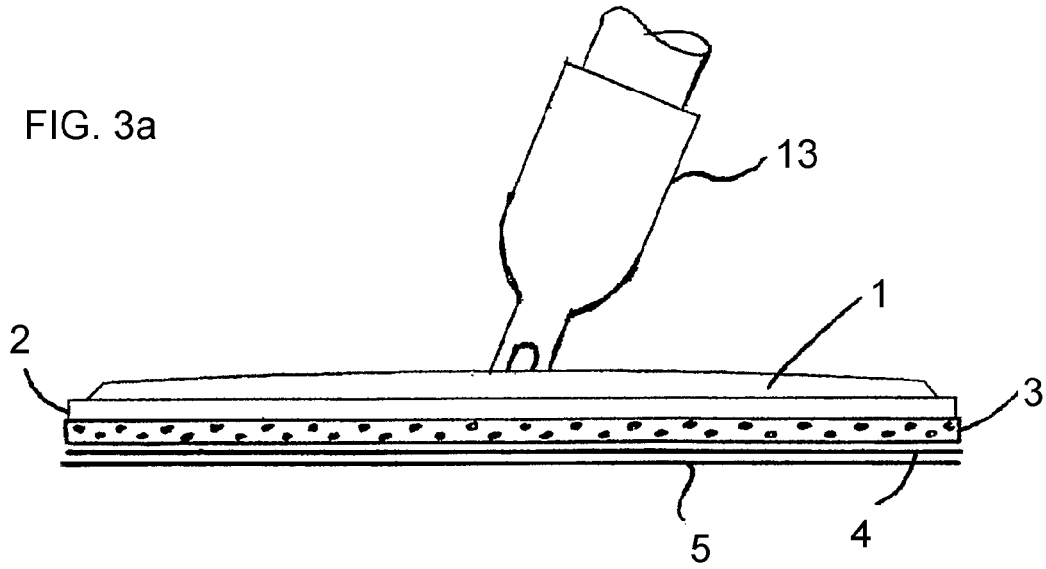
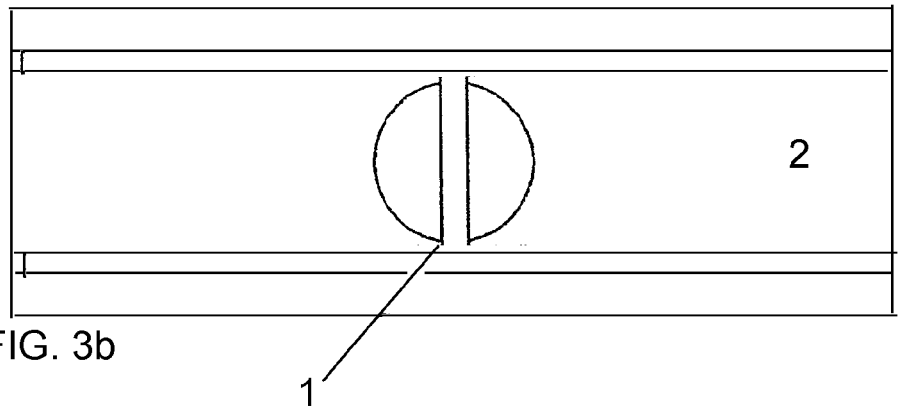
FIG. 3b
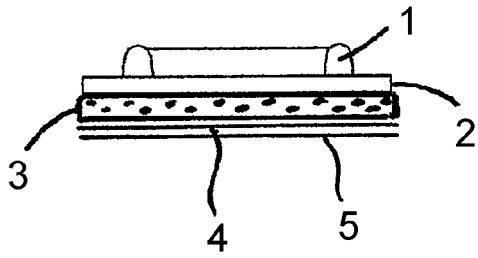
FIG. 3c

FIG. 6a
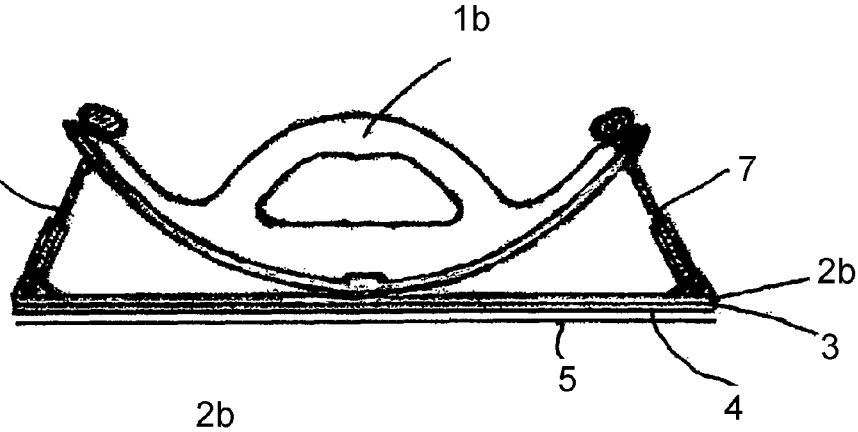
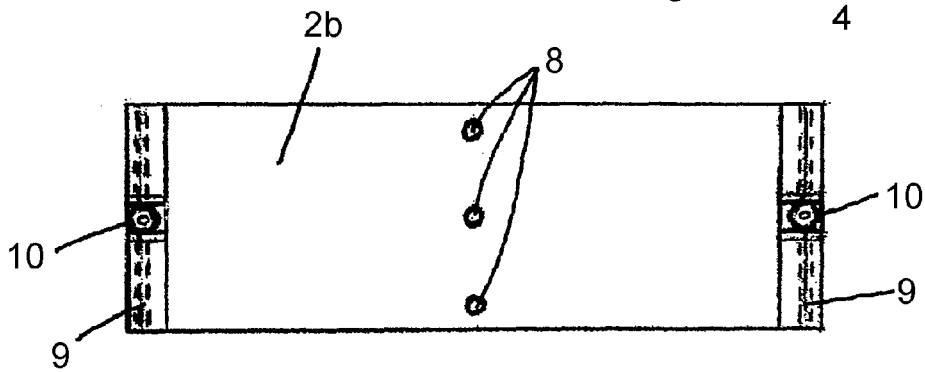
FIG. 6b

FIG. 8a
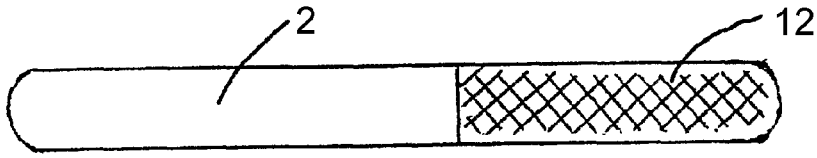
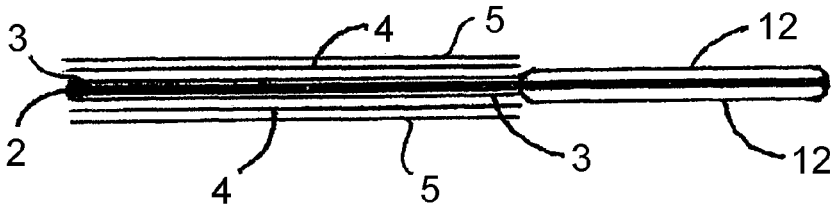
FIG. 8b

ABRASIVE HOLDER

CROSS REFERENCE TO RELATED APPLICATION

This application is a continuation-in-part based upon U.S. patent application Ser. No. 10/523,183, filed Jan. 28, 2005 now U.S. Pat. No. 7,131,902 which is based upon International Application No. PCT/NZ2003/000190 filed Aug. 28, 2005. Additionally, this U.S. continuation-in-part application claims the benefit of priority of co-pending U.S. patent application Ser. No. 10/523,186, filed Jan. 28, 2005, International Application No. PCT/NZ2003/000190 filed Aug. 28, 2005 and New Zealand Application No. NZ 519162 filed Aug. 27, 2002. The entire disclosures of the prior applications are incorporated herein by reference.

BACKGROUND OF THE INVENTION

1. Field of the Invention

This invention relates to a system for holding an abrasive medium to a tool and in particular, though not solely, the invention relates to a system for effectively holding an abrasive medium to a sanding hand tool.

2. Description of the Prior Art

Sanding tools are used widely and available in a variety of shapes and sizes to suit their particular application or desired use. In general, it may be said that there are three main configurations utilized to locate and hold an abrasive material such as sandpaper in position against a supporting tool body (which may be a power tool or hand tool). These three types can be classified according to the following descriptions:

1. screw down clips or clamps to allow an abrasive material, such as sandpaper to be wrapped around the ends of the tool and clamped onto the tool by such screw-down clips or clamps; or 2. hook and loop systems (such as VELCRO with either hooks or loops provided on a base of the tool body and loops or hooks provided on the back surface of the sandpaper; or 3. various foam pads glued to a base of the body of the tool (i.e. the abrasive support portion of the tool) where the exposed or 'skin' side of the foam has applied thereto abrasives by, for example, pressure sensitive adhesive to allow it to stick to the foam. Foam pads may be made, for example, from Ethyl Vinyl Acetate (EVA) and may be incorporated in sanding tools having screw down clips of clamps or hook and loop fastening systems.

Foam pads provide a cushion between the tool and the surface to be sanded.

Problems exist with current sanding tool design, in particular as the types of tool configurations requiring screw-down clips or clamps for holding the abrasive material in place do not tend to facilitate simple abrasive material attachment. In addition, the present abrasive material holder systems generally make fitting of abrasive material a slow and fiddly process, and screw-down clamp type systems can result in wastage of abrasive material when attempting to ensure correct fitting of the material.

The hook and loop system of holding the abrasive material to a sanding tool can be expensive, and the tool system utilizing EVA foam can be problematic due to foam materials being porous by nature and not therefore conducive to adhering abrasive material such as sandpaper thereto. It is known that since foams, such as EVA, are produced from moulds and subsequently cut into slabs, a shiny, or smoother skin surface occurs against the mould surface. This skin material, which is in general the off-cut from batch EVA production processes is conducive to adhering abrasive material such as sand paper thereto. The availability of this EVA skin material is however not currently sufficient to allow production of sanding tools on an industrial scale.

It is therefore an object of the present invention to provide an abrasive tool or a system for holding an abrasive medium to a hand tool which will go at least some way towards overcoming the above disadvantages or which will at least provide the industry and/or public with a useful choice.

Therefore, it is desirable to provide a system which may be utilized with sanding tools to provide a surface capable of attaching and providing a good adhesive surface for the adhesive backed abrasive material sheet whilst also being able to provide a more economic and/or less awkward system for connecting together a sanding tool body and an abrasive material sheet.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning i.e. that it will be taken to mean an inclusion of not only the listed components it directly references, but also other non-specified components or elements. This rationale will also be used when the term 'comprised' or 'comprising' is used in relation to one or more steps in a method or process.

Further aspects and advantages of the present invention will become apparent from the ensuing description which is given by way of example only.

SUMMARY OF THE INVENTION

In a first aspect, the invention consists in an abrasive tool comprising: a base portion, and a plastics film layer on said base portion adapted to receive an abrasive material layer.

Preferably, said base portion includes a foam layer to which said plastics film layer is applied.

Preferably, an abrasive material layer is applied to said plastics film layer.

Preferably, said abrasive material layer comprises abrasive material fixed to a backing layer wherein the backing layer is applied to the plastics film layer.

Preferably, said backing layer is provided with an adhesive to attach the abrasive material layer to the plastics film layer.

Preferably, the adhesive is a pressure sensitive adhesive.

Preferably, said foam layer is formed from ethyl vinyl acetate foam or polyethylene foam or polypropylene foam.

Preferably, said plastics film layer is formed from ethyl vinyl acetate film or polyethylene film or polypropylene.

Preferably, said plastics film layer is applied to said foam layer by laminating during formation of the foam layer, by bringing the foam and plastic film layers together while the plastic film layer is being extruded and is in an almost molten state.

Preferably, a handle is connected to the base portion of the tool.

Preferably, the base portion is substantially planar.

Preferably, the base portion is flexible and means are provided on the tool for adjusting the curvature of the base portion and fixing the curvature of the base portion once adjusted.

Preferably, said curvature of the base portion may be concave or convex.

Preferably, said base portion is connected to a handle portion about a central pivot line and adjustment means are provided at respective spaced apart ends of the handle portion to allow the ends of the base portion to be moved closer to or further away from the respective ends of the base portion.

Preferably, each said adjustment means has a pivotable connection with a respective end of the base portion.

Preferably, each said adjustment means comprises a screw member passing through a respective end of the handle portion and received within a socket pivotably connected to a respective end of the base portion.

Preferably, each socket is pivotable about a rod fixed within an end of the base portion, wherein the rod is fixed to the base portion substantially across the entire width of the base portion.

In a second aspect, the invention consists in an abrasive tool comprising: a handle portion, a flexible base portion connected to the handle portion about a central pivot line, and adjustment means between the handle and base portions for adjustably fixing the curvature of the base portion.

Preferably, said curvature of the base portion may be concave or convex.

Preferably, said base portion is connected to the handle portion about a central pivot line and adjustment means are provided at respective spaced apart ends of the handle portion to allow the ends of the base portion to be moved closer to or further away from the respective ends of the base portion.

Preferably, each said adjustment means has a pivotable connection with a respective end of the base portion.

Preferably, each said adjustment means comprises a screw member passing through a respective end of the handle portion and received within a socket pivotably connected to a respective end of the base portion.

Preferably, each socket is pivotable about a rod fixed within an end of the base portion, wherein the rod is fixed to the base portion substantially across the entire width of the base portion.

Preferably, a plastics film layer is provided on the outer surface of the base portion.

Preferably, the base portion includes a foam layer to which said plastics film layer is applied.

Preferably, an abrasive material layer is applied to said plastics film layer.

Preferably, said abrasive layer comprises abrasive material fixed to a backing layer wherein the backing layer is applied to the plastics film layer.

Preferably, said backing layer is provided with an adhesive to attach the abrasive material layer to the plastics film layer.

Preferably, the adhesive is a pressure sensitive adhesive.

Preferably, said foam layer is formed from ethyl vinyl acetate foam or polyethylene foam or polypropylene.

Preferably, said plastics film layer is formed from ethyl vinyl acetate film or polyethylene film or polypropylene.

Preferably, said plastics film layer is applied to said foam layer by laminating during formation of the foam layer, by bringing the foam and plastic film layers together while the plastic film layer is being extruded and is in an almost molten state.

BRIEF DESCRIPTION OF THE DRAWINGS

Further aspects of the present invention will become apparent from the ensuing description which is given by way of example only and with reference to the accompanying drawings in which:

FIG. 1A illustrates a side elevational view of one embodiment of a sanding tool incorporating an abrasive holder system according to the present invention;

FIG. 1B illustrates a plan view of a sanding tool FIG. 1A;

FIG. 1C illustrates an end elevational view of a sanding tool FIG. 1A;

FIG. 2A illustrates a side elevational view of a second embodiment of a sanding tool in accordance with the present invention;

FIG. 2B illustrates a plan view of the sanding tool illustrated in FIG. 2A;

FIG. 2C illustrates an end elevational view of the sanding tool illustrated in FIG. 2A;

FIG. 3A illustrates a side elevational view of a third embodiment of a sanding tool in accordance with the present invention;

FIG. 3B illustrates a plan view of the sanding tool illustrated in FIG. 3A;

FIG. 3C illustrates an end elevational view of the sanding tool illustrated in FIG. 3A;

FIG. 5C illustrates an end elevational view of the sanding tool illustrated in

FIG. 5A;

FIG. 6A illustrates a side elevational view of a further aspect of a sanding tool according to the present invention;

FIG. 6B illustrates an underneath view of FIG. 6A with sandpaper removed.

FIG. 8A illustrates a plan view of an sixth embodiment of a sanding tool according to the present invention;

FIG. 8B illustrates a side elevational view of FIG. 8A with sandpaper removed.

DESCRIPTION OF THE PREFERRED EMBODIMENT

Figure 4A:
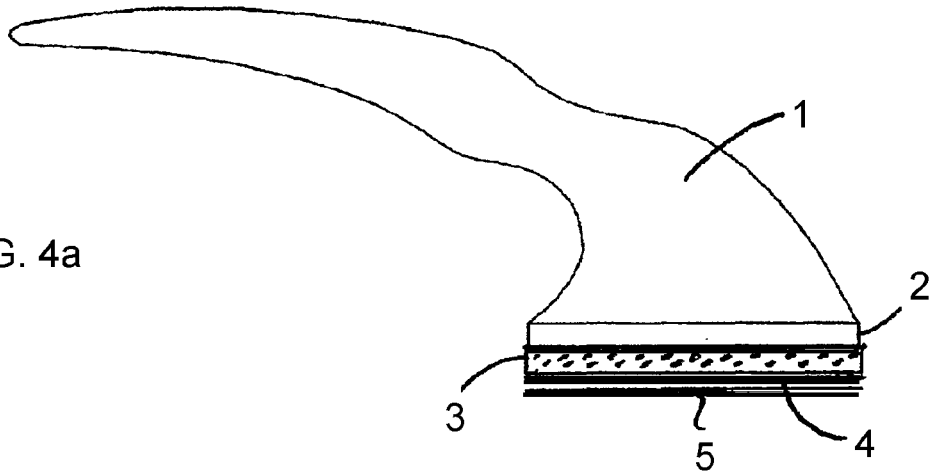
FIG. 4A illustrates a side elevational view of a fourth embodiment of a sanding tool in accordance with the present invention in an alternative configuration to FIG. 1A, 2A or 3A.
Figure 4B:
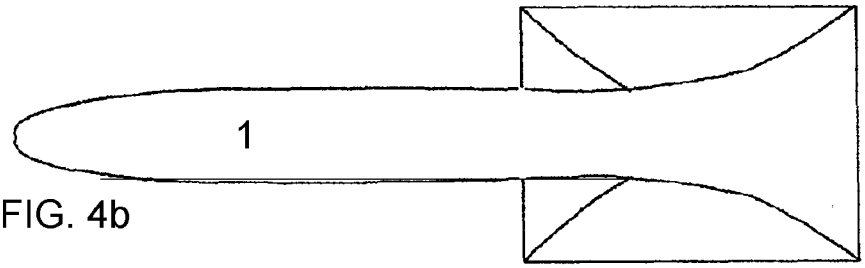
FIG. 4B illustrates a plan view of the sanding tool illustrated in FIG. 4A.
Figure 4C:
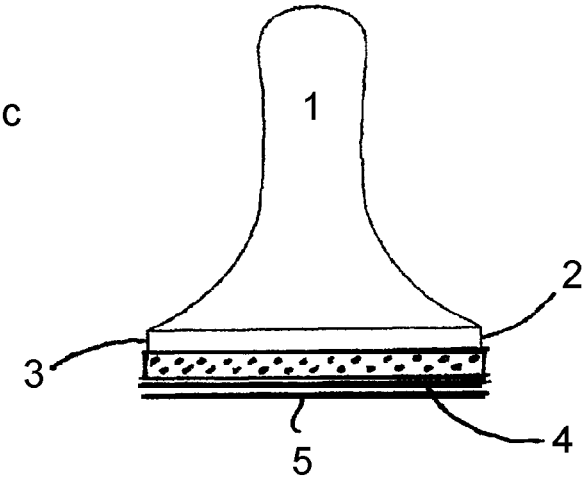
FIG. 4C illustrates an end elevational view of the sanding tool illustrated in FIG. 4A.
Figure 5A:
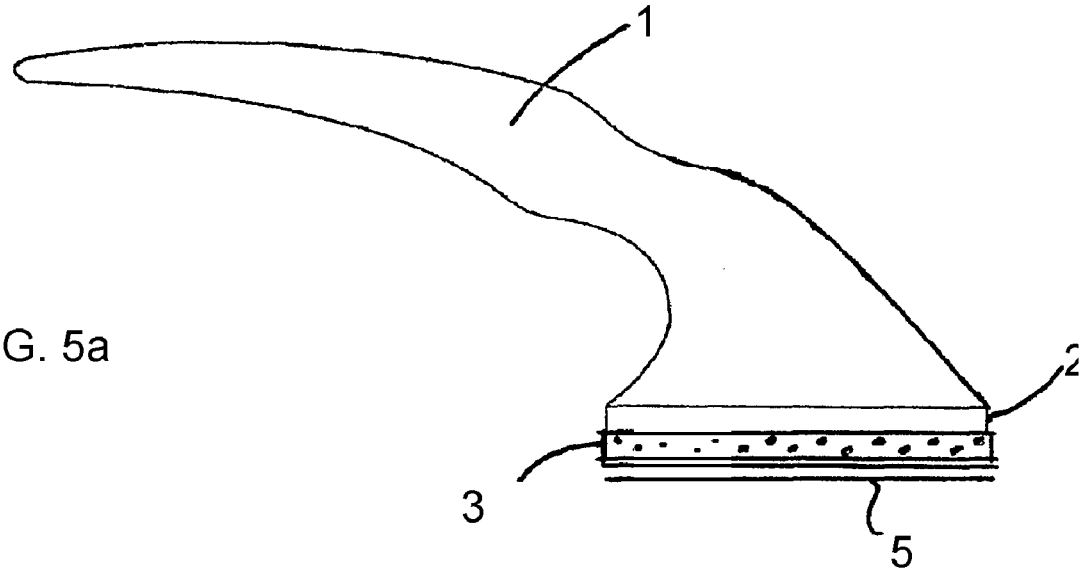
FIG. 5A illustrates a side elevational view of a fifth embodiment of a sanding tool according to the present invention.
Figure 5B:
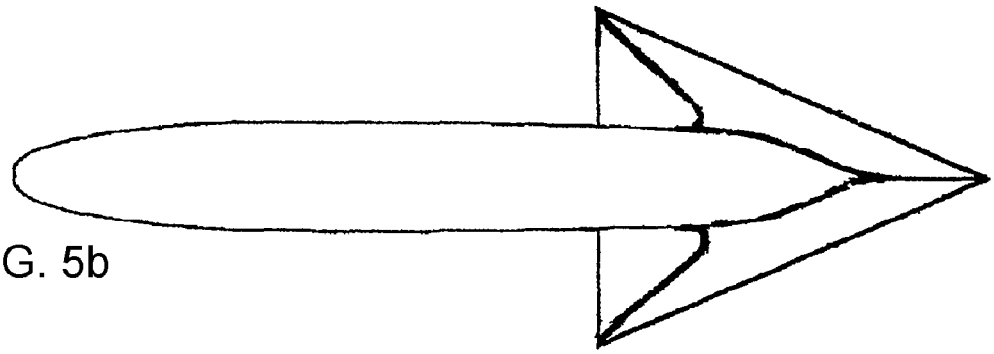
FIG. 5B illustrates a plan view of the sanding tool illustrated in FIG. 5A.
Figure 5C:
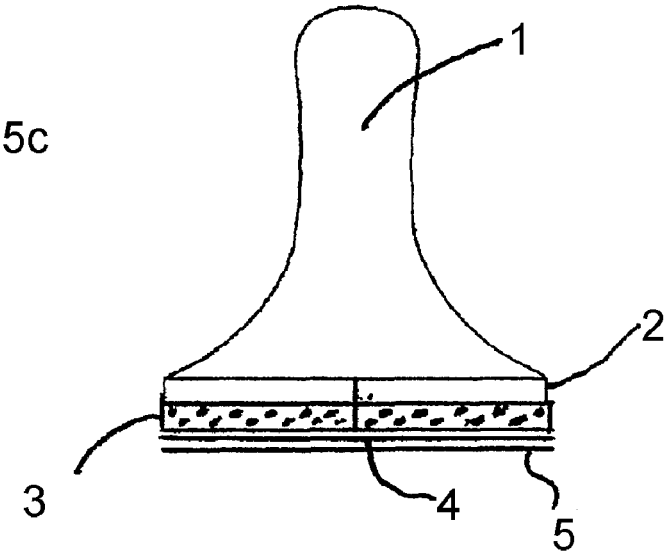

With reference to FIGS. 1A, 1B and 1C there is shown a first embodiment of a sanding tool incorporating an abrasive system according to the present invention.

The sanding or abrasive tool includes a handle 1 having a planar support base 2 onto which is attached a foam material 3, for example EVA, polypropylene or polyethylene or other suitable foam material. A durable film 4 such as EVA, polypropylene or polyethylene or other plastics film is glued or laminated or bonded onto the outer face of foam layer 3 and a layer of abrasive material 5 such as sandpaper is adhered to the film layer 4. The film 4 can be permanently bonded to the foam layer 3 while the plastic film layer is being extruded and is in an almost molten state.

The sandpaper layer 5 may be adhered to the film layer 4 by a pressure sensitive adhesive applied to the back side of the sandpaper which allows the sandpaper to stick (and hold fast to) the film 4. The sandpaper layer 5 may also desirably allow peeling of the sandpaper from film 4 either after use or as and when required such as when the abrasive material on the front face of the sandpaper is worn down, or a different grade of sandpaper is required.

With reference to FIGS. 2*a*, 2*b* and 2*c*, there is shown a second embodiment of the sanding tool according to the present invention. The second embodiment is very similar to the first embodiment except for an alternatively shaped handle 1.

Similarly, FIGS. 3, 3*a* and 3*b* illustrate a third embodiment of a sanding tool according to the present invention, which utilizes a swivel handle 13 connected to a base plate 1 having a planar support base 2 to attach suitable foam material.

FIGS. 4*a*, 4*b*, 4*c* and 5*a*, 5*b* and 5*c* illustrate fourth and fifth embodiments of hand-held sander tools which may utilize the foam, film, abrasive material laminate configuration described with reference to the first to third embodiments but with alternatively shaped handle and/or support base shapes.

FIGS. 6*a* and 6*b* illustrate a further embodiment of the present invention including a handle 1*b* additionally providing a bendable and adjustable support base portion 2*b* onto which is attached suitable foam material 3 (for example EVA or other suitable foam material) and onto which a suitably durable film 4 may be glued or laminated. The film 4 is applied to the foam layer 3 to allow abrasive sandpaper or the like having suitable pressure sensitive or other types of adhesive applied to one side thereof, to stick and hold the sandpaper to the film 4.

As mentioned previously, the sandpaper/abrasive may also be able to be releasable from film 4 by peeling said sandpaper therefrom, as and when required. Adjusting screws 7 are also provided to adjust the convex curve of the support base 2*b* for sanding inside curved corners. Attachment of mounting points 8 may also be provided in such an embodiment, thereby allowing the base 2*b* to be adjustable in shape, allowing for a flat, convex or concave sanding surface. The foam (and film layers 4) can in this way be connected in such a way to a sander tool as to utilize the foam/film layer flexibility and flex the materials about the base 2*b*, or any curved position or base 2*b* shape as dictates by the adjustable screws 7. The base 2*b* may also be connected to the hand tool by points 8 (which may be in the form of a tongue-in-groove or key in slot configuration). Adjustable screws 7 may connect via connection point 10 with an axle 9 extending substantially the width of the base 2*b*. The position of such an axle allows uniform pressure to be maintained along the width edge of the foam/film/base layers. The connection point 10 may be in the form of a universal ball joint or similar which allows the base 2*b* and attachment layers 3, 4 to rotate relative to the body of the tool 16 in sympathy with a surface being sanded.

Figure 7A:
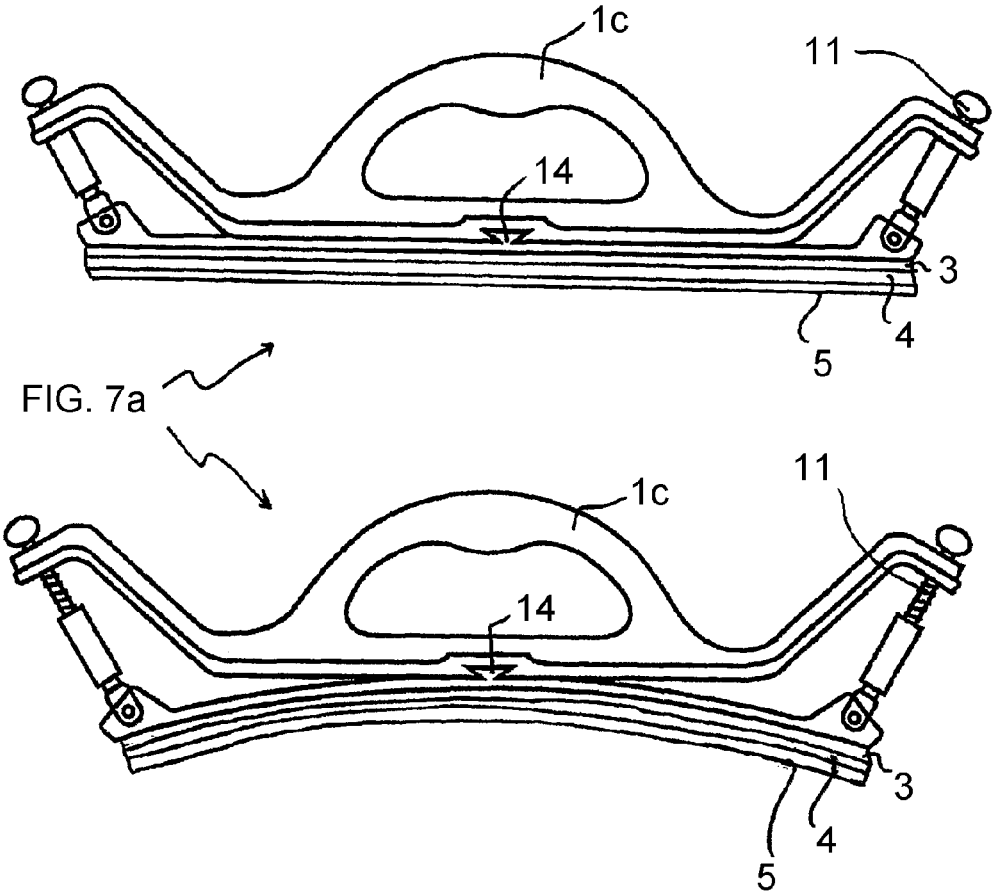
FIG. 7A illustrates a side elevational view of a second embodiment of the further aspect of a sanding tool according to the present invention.
Figure 7B:
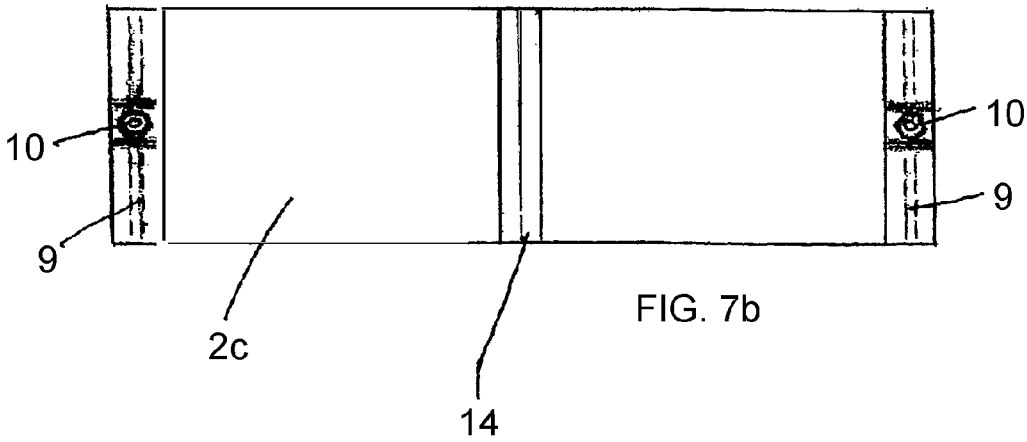
FIG. 7B illustrates an underneath view of FIG. 7A with sandpaper removed.

With reference to FIGS. 7*a* and 7*b* there is shown a further preferred embodiment of the present invention in the form of an abrasive holder handle 1*c*, a flat bendable and adjustable base portion 2*c* on to which is attached suitable foam material 3 and to which a suitably durable film 4 is glued or laminated.

Abrasive sandpaper 5 may then be adhered to film 4 and preferably be easily releasable therefrom by peeling as and when required. Adjustment means 11 such as an adjustable screw (similar to adjustable screw 7) may be utilized in a similar fashion to the embodiment illustrated in FIGS. 6*a*, 6*b* and as previously described. Such an adjustable screw may be connected to an axle 9 substantially extending the width of the base 2*b* via a universal connection joint. In particular this embodiment of an abrasive tool (and holder) may be utilized for the sanding of concave surfaces; where screws 7 may be extended to push the base 2*b* connected at points 9, 10 away from the tool body 1*c*, whilst a central portion of the base 2*b* remains fixed at 14.

With reference to FIGS. 8*a* and 8*b* there is shown a further embodiment of the present invention in the form of a file including a handle 12, a flat stiff or flexible base 2 to attach suitable foam material 3 (such as EVA or other suitable foam material) and to which a suitably durable film 4 is glued or applied or laminated. The film 4 can be permanently bonded to the foam material 3 while the film is being extruded and is in an almost molten state.

An abrasive material such as sandpaper 5 is applied to film 4 preferably in such a way that the sandpaper abrasive is easily releasable from the film 4 by peeling said off and when required. A suitable flat or handled sanding tool for the purpose of filing human nails, or animal nails or hoofs is thereby provided.

Although not shown, it should be appreciate that the tool could be formed from a solid or composite body made entirely from EVA, or Polyethylene, or rubber, or cork, or composite materials, or any other suitable materials, and where a film layer can be laminated directly to the flat base of the body, while the film layer is being extruded and is in an almost molten state. Abrasives having pressure sensitive adhesive applied to one side can then be applied to, and easily removable from, the film layer. The block of, for example, EVA, could be moulded to form a handle so that the tool looks much like the tool shown in FIGS. 1*a* to 1*c*.

In the above described embodiments there is provided a series of sanding tools having square, rectangular, triangular, oval, or any suitable shaped base to which a layer of foam such as Ethyl Vinyl Acetate (EVA), or Polyethylene (PE), or any other suitable foam can be glued. A handle may be attached to the upper side of the base of the tool by which to push, pull, and move the tool to perform sanding.

The EVA foam, or PE foam, or any other suitable foam will have a suitable plastics film such as Polyethylene film, or any other suitable film laminated thereto. This laminated film creates a much more durable surface on the EVA foam onto which abrasives coated with any suitable adhesive (such as pressure sensitive adhesive) can be stuck and applied to. The plastic film can be permanently bonded to the foam while the plastic film is being extruded and is in an almost molten state. Preferably, pressure sensitive adhesive backed sandpaper abrasive can be easily peeled off and released from the film laminated side of the foam.

The film layer laminated to the foam layer could also be imprinted with branding or any suitable printed information on the side of the film to be laminated to the foam, thereby providing branding or printing that is free from wear and tear or damage.

The EVA or other suitable foam adhered to the base can be of any suitable thickness from less than about 1 mm thick to about 25 mm thick or more.

While it is desirable to apply plastics film to the foam, the foam could alternatively have any suitable coating applied to its surface which would create a surface suitable for attaching, adhering and removing abrasives with a suitable adhesive.

The abrasive material could have any suitable and removable waxed paper, or any other suitable removable protective backing paper or film applied thereto to enable peeling from the film layer.

As mentioned above in relation to FIGS. 6 and 7, the abrasive holders or sanding tools according to the present invention may have adjustable bases that can be adjusted to create either a concave or convex curve to conform to fit any curved surface to be sanded.

The present invention is limited to hand and operated tools and may be used in hand held and operated electric sanding tools and hand held and operated pneumatic sanding tools. It should also be noted that the film layer may be applied directly to the bottom base of the sanding tool without the need for the foam layer where the tool may be made entirely from rubber, synthetic compound, cork, or any other suitable material including composite materials to provide the necessary elasticity to the sandpaper. The file embodiment of FIGS. 8*a* and 8*b* may have a flat thin base with rounded or square or other shaped ends.

The EVA foam pad preferably has a thickness of between approximately 0.5 mm and 25 mm, and the foam may be of a density ranging from 20 to over 200 kg.m.

The film layer may be applied to the foam layer or directly to the base of the tool with any suitable glue or heat laminating or other suitable application system.

Abrasive material such as sandpaper having a suitable pressure sensitive adhesive (PSA) applied to one side thereof can be attached to the film layer by peeling the protective backing paper from the PSA side of the sandpaper and sticking the sandpaper to the film layer.

Aspects of the present invention have been described by way of example only and it should be appreciated that modifications and additions may be made thereto without departing from the scope thereof as defined in the appended claims.

What is claimed as being new and desired to be protected by Letters Patent of the United States is as follows:

1. A hand held abrasive tool for sanding planar or curved surfaces, said hand held abrasive tool comprising:

a base portion having a substantially planar surface;

a handle attachable to said base portion via at least one attachment point;

a foam layer permanently bonded to said base portion;

a plastics film layer permanently bonded to said foam layer and adapted to removably receive an adhesively backed abrasive paper;

a first and second axle each of which fixed within opposite ends of said base portion and substantially across the entire width of said base portion, said axles being adapted to maintain uniform pressure along the width edge of said base portion; and a first and second adjustment mechanisms each of which passing through an end of said handle portion respectively, said first adjustment mechanism free end being attachable to said first axle via a universal ball joint centrally located on said first axle, said second adjustment mechanism free end being attachable to said second axle via a universal ball joint centrally located on said second axle;

wherein said first and second adjustment mechanisms being adapted for adjustably fixing the curvature of said base portion.

2. The hand held abrasive tool as claimed in claim 1, wherein said foam layer is formed from a material selected from the group consisting of ethyl vinyl acetate foam, and polypropylene foam.

3. The hand held abrasive tool as claimed in claim 2, wherein said plastics film layer is formed from the group consisting of polypropylene film, and polyethylene film.

4. The hand held abrasive tool as claimed in claim 3, wherein said base portion is substantially planar.

5. The hand held abrasive tool as claimed in claim 3, wherein each of said ends of said handle extends outwardly away from said attachment point at an angle thereby producing a gap between each end of said handle and each end of said base portion respectively.

6. The hand held abrasive tool as claimed in claim 5, wherein said base portion is connectable to said handle by way of said attachment point about a central pivot line located along the entire central width of said base portion and said handle, and wherein said attachment point is a tongue-in-groove configuration.

7. A hand held abrasive tool comprising:

a handle portion having a central portion and ends opposite of each other which extend outwardly away from said central portion at an angle;

a flexible base portion removably attachable, along the entire central width of said flexible base portion and said handle, to said handle portion about a central pivot line;

a foam layer permanently bonded to said flexible base portion;

a plastic film layer permanently bonded to said foam layer;

a first and second adjustment mechanisms for adjustably fixing the curvature of said flexible base portion, said first and second adjustment mechanisms each of which being attachable to said ends of said handle and to ends of said flexible base respectively and or opposite each other, wherein one end of said first adjustment mechanism passes through one of said ends of said handle with the free end of said first adjustment mechanism being attachable to one of said ends of said flexible base, and wherein one end of said second adjustment mechanism passes through the opposite said end of said handle with the free end of said second adjustment mechanism being attachable to the opposite said end of said flexible base; and a first and second socket each of which being pivotably connected to said ends of said flexible base portion respectively, said first socket adapted to receive said free end of said first adjustment mechanism and pivotably connect said first adjustment mechanism to said end of said flexible base portion, said second socket adapted to receive said free end of said second adjustment mechanism and pivotably connect said second adjustment mechanism to said end of said flexible base portion opposite of said first socket.

8. The hand held abrasive tool as set forth in claim 7 further comprising an abrasive material layer attachable to said plastic film layer.

9. The hand held abrasive tool as set forth in claim 8, wherein said abrasive layer comprises abrasive material fixed to a backing layer, said backing layer being attachable to said plastic film layer.

10. The hand held abrasive tool as set forth in claim 9, wherein said backing layer of said abrasive layer is provided with an adhesive to removably attach said backing layer to said plastic film layer.

11. The hand held abrasive tool as set forth in claim 10, wherein said adhesive is a pressure sensitive adhesive.

12. The hand held abrasive tool as set forth in claim 7, wherein said foam layer is selected from the group consisting of ethyl vinyl acetate foam, and polypropylene.

13. The hand held abrasive tool as set forth in claim 7, wherein said plastic film layer is selected from the group consisting of polyethylene film, and polypropylene.

14. The hand held abrasive tool as set forth in claim 13, wherein said plastic film layer is applied to said foam layer by laminating during formation of said foam layer.

15. The hand held abrasive tool as set forth in claim 7, wherein each of said first and second sockets are a universal ball joint.

16. The hand held abrasive tool as set forth in claim 15, wherein said first adjustment mechanism and said second adjustment mechanism are screw members, said screw members passing through their respective ends of said handle portion.

17. The hand held abrasive tool as set forth in claim 16, further comprising a rod fixed within each end of said flexible base portion substantially across the entire width of said flexible base portion, wherein each of said sockets are pivotable about and centrally connected to their said respective rods fixed within their respective ends of said flexible base portion, said rods being adapted to maintain uniform pressure along the width edge of said flexible base portion.

18. The hand held abrasive tool as set forth in claim 7, wherein said ends of said handle extend outwardly and angularly away from said central pivot line which is adapted to produce a gap between each end of said handle and each end of said flexible base portion respectively.

19. The hand held abrasive tool as set forth in claim 7, wherein said flexible base portion is removably attached to said handle portion by a key in slot configuration located on said central pivot line.

20. A hand held abrasive tool comprising:

a flexible base portion;

a foam layer permanently bonded to said flexible base portion;

a plastic film layer permanently bonded to said foam layer;

a handle portion removably attachable to said flexible base portion about a central pivot line extending the entire width of said handle portion and said flexible base portion, said handle portion having ends opposite of each other which extend outwardly and angularly away from said handle portion respectively thereby producing a gap between said ends of said handle and ends of said flexible base portion;

a first and second axle each of which fixed within said ends of said base portion respectively and substantially across the entire width of said base portion, said axles being adapted to maintain uniform pressure along the width edge of said base portion;

a first and second adjustment mechanisms for adjustably fixing the curvature of said flexible base portion, said first and second adjustment mechanisms each of which being attachable to said ends of said handle and to ends of said flexible base respectively, wherein one end of said first adjustment mechanism passes through one of said ends of said handle with the free end of said first adjustment mechanism being attachable to one of said axles in said flexible base, and wherein one end of said second adjustment means passes through the opposite said end of said handle with the free end of said second adjustment mechanism being attachable to the opposite said axle in said flexible base; and a first and second socket each of which being pivotably and centrally connected to said axles in said flexible base portion respectively, said first socket adapted to receive said free end of said first adjustment mechanism and pivotably connect said first adjustment mechanism to said end of said flexible base portion via said axle, said second socket adapted to receive said free end of said second adjustment mechanism and pivotably connect said second adjustment mechanism to said end of said flexible base portion opposite of said first socket via said axle;

wherein said handle portion is removably attached to said flexible base portion through a tongue-in-groove configuration located along said central pivot line;

wherein said first and second sockets are each a universal ball joint.

* * * * *